US011220724B2

(12) United States Patent
Wang et al.

(10) Patent No.: US 11,220,724 B2
(45) Date of Patent: Jan. 11, 2022

(54) 980 MPA-GRADE HOT-ROLLED FERRITIC BAINITE DUAL-PHASE STEEL AND MANUFACTURING METHOD THEREFOR

(71) Applicant: BAOSHAN IRON & STEEL CO., LTD., Shanghai (CN)

(72) Inventors: Huanrong Wang, Shanghai (CN); Ana Yang, Shanghai (CN); Jiansu Zhang, Shanghai (CN); Wei Wang, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 290 days.

(21) Appl. No.: 16/311,480

(22) PCT Filed: Jun. 19, 2017

(86) PCT No.: PCT/CN2017/088962
§ 371 (c)(1),
(2) Date: Dec. 19, 2018

(87) PCT Pub. No.: WO2017/219938
PCT Pub. Date: Dec. 28, 2017

(65) Prior Publication Data

US 2019/0194772 A1 Jun. 27, 2019

(30) Foreign Application Priority Data

Jun. 21, 2016 (CN) ..... 201610450203.X

(51) Int. Cl.
*C21D 9/46* (2006.01)
*C22C 38/02* (2006.01)
(Continued)

(52) U.S. Cl.
CPC ..... *C21D 9/46* (2013.01); *C21D 6/005* (2013.01); *C21D 6/008* (2013.01); *C21D 8/0205* (2013.01);
(Continued)

(58) Field of Classification Search
CPC ..... C21D 9/46; C21D 8/0263; C21D 6/005; C21D 6/008; C21D 8/0205; C21D 8/0226;
(Continued)

(56) References Cited

U.S. PATENT DOCUMENTS 5,529,646 A * 6/1996 Nakajima ..... C21D 1/09 148/525
6,475,308 B1 * 11/2002 Issartel ..... C21D 8/0426 148/333
(Continued)

FOREIGN PATENT DOCUMENTS

CN 101331019 12/2008
CN 103320701 9/2013
(Continued)

OTHER PUBLICATIONS

JP Office Action dated Dec. 3, 2019 for Japanese Patent Application No. 2018-566512.
(Continued)

*Primary Examiner* — John A Hevey
(74) *Attorney, Agent, or Firm* — Lei Fang; Smith Tempel Blaha LLC

(57) ABSTRACT

A 980 MPa-grade hot-rolled ferrite bainite dual-phase steel and a manufacturing method therefor. The chemical components of the steel comprise, in percentage by weight, 0.15-0.30% of C, 0.8-2.0% of Si, 1.0-2.0% of Mn, 0-0.02% of P, 0-0.005% of S, 0-0.003% of O, 0.5-1.0% of Al, 0-0.006% of N, 0.01-0.06% of Nb, 0.01-0.05% of Ti, and the
(Continued)

balance of Fe and inevitable impurities. In addition, the chemical components meet the following relations: 0.05%≤Nb+Ti≤0.10%, and 2.5≤Al/C≤5.0. The microstructure of the steel is made of ferrite and bainite. The average grain size of the ferrite is 5-10 μm, and the equivalent grain size of the bainite is less than or equal to 20 μm. The yield strength of the steel is greater than or equal to 600 MPa, the tensile strength of the steel is greater than or equal to 980 Mpa, and the ductility is greater than or equal to 15%.

12 Claims, 3 Drawing Sheets

(51) Int. Cl.

| | |
|---|---|
| ***C22C 38/04*** | (2006.01) |
| ***C22C 38/06*** | (2006.01) |
| ***C22C 38/12*** | (2006.01) |
| ***C22C 38/14*** | (2006.01) |
| ***C21D 8/02*** | (2006.01) |
| ***C21D 6/00*** | (2006.01) |
| ***C22C 38/00*** | (2006.01) |

(52) U.S. Cl.
CPC ..... *C21D 8/0226* (2013.01); *C21D 8/0247* (2013.01); *C21D 8/0263* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C21D 2211/002* (2013.01); *C21D 2211/005* (2013.01)

(58) Field of Classification Search
CPC ..... C21D 8/0247; C21D 2211/002; C21D 2211/005; C22C 38/001; C22C 38/002; C22C 38/02; C22C 38/04; C22C 38/06; C22C 38/12; C22C 38/14
See application file for complete search history.

(56) References Cited

U.S. PATENT DOCUMENTS

| | | | | |
|---|---|---|---|---|
| 2005/0150580 | A1* | 7/2005 | Akamizu | C21D 8/0278 148/654 |
| 2012/0012231 | A1* | 1/2012 | Murakami | C22C 1/002 148/504 |
| 2014/0234657 | A1* | 8/2014 | Azuma | C22C 38/001 428/659 |
| 2018/0237874 | A1* | 8/2018 | Yamazaki | C22C 38/60 |

FOREIGN PATENT DOCUMENTS

| | | |
|---|---|---|
| CN | 105925887 | 9/2016 |
| EP | 1391526 | 4/2004 |
| JP | 2005120435 | 5/2005 |
| JP | 2007023339 | 2/2007 |
| JP | 2009007659 | 1/2009 |
| JP | 2009019214 | 1/2009 |
| JP | 2012041573 | 3/2012 |
| JP | 2012251201 | 12/2012 |
| JP | 2013044003 | 3/2013 |
| JP | 2015145518 | 8/2015 |
| WO | 2012128206 | 7/2014 |

OTHER PUBLICATIONS

PCT Patent Application PCT/CN2017/088962 filed on Jun. 19, 2017, International Searcher Report and Written Opinion dated Dec. 28, 2017.

* cited by examiner

980 MPA-GRADE HOT-ROLLED FERRITIC BAINITE DUAL-PHASE STEEL AND MANUFACTURING METHOD THEREFOR

CROSS-REFERENCE TO RELATED APPLICATIONS

This application is a 371 U.S. National Phase of PCT International Application No. PCT/CN2017/088962 filed on Jun. 19, 2017, which claims benefit and priority to Chinese patent application no. 201610450203.X, filed on Jun. 21, 2016. Both of the above-referenced applications are incorporated by reference herein in their entireties.

TECHNICAL FIELD

The disclosure pertains to the field of hot-rolled high-strength steel, and particularly relates to a 980 MPa-grade hot-rolled ferrite-bainite dual-phase steel and a method for manufacturing the same.

BACKGROUND ART

Nowadays, carriage wheels of business vehicles, especially heavy trucks, are generally manufactured with dual-phase steel. In order to reduce cost, steel wheels are also used for some economical cars (including rims and spokes). Use of high-strength dual-phase steel for manufacturing carriage wheels can reduce wheel weight effectively. For instance, in comparison with common Q345 steel, use of DP600 (i.e. dual-phase steel having a tensile strength of grade 600 MPa) can reduce wheel weight by about 10-15%; and use of DP780 dual-phase steel having a tensile strength of grade 780 MPa can reduce wheel weight by about 5-10% additionally. Dual-phase steel used currently by an overwhelming majority of the domestic carriage wheel manufacturers is mainly low-strength dual-phase steel of 600 MPa or lower. Higher strength dual-phase steel such as DP780 is seldom utilized.

The main reason for wide use of dual-phase steel for carriage wheels of vehicles is that dual-phase steel is inherently characterized by low yield strength, high tensile strength (i.e. low yield ratio), continuous yielding and good processability and formability, etc. However, the greatest disadvantage of ferrite+martensite type high-strength dual-phase steel for manufacturing wheels is its poor hole expandability. At the same strength level, ferrite-martensite dual-phase steel has the lowest hole expansion ratio. The main reason for this is that the ferrite and martensite phases have significantly different mechanical properties, leading to a high work hardening rate, easy generation of microcracks around a punched hole, and cracking during hole expansion and shaping. Bainite or ferrite+bainite structure having the same strength grade exhibits more superior hole expandability. Ferrite+bainite dual-phase steel has a relatively low yield ratio, good hole expandability, plasticity and impact toughness. In the field of ultrahigh-strength wheel steel (e.g. ≥780 MPa), ferrite+bainite dual-phase steel is more promising in its potential application than ferrite+martensite dual-phase steel.

Existing dual-phase steel is mainly ferrite+martensite dual-phase steel, among which cold-rolled ferrite+martensite dual-phase steel dominates. Hot-rolled ferrite+martensite dual-phase steel having a strength grade of 780 MPa or above can rarely be seen, and there is even less high-strength (≥780 MPa) ferrite+bainite dual-phase steel.

A Chinese Patent Application Publication CN101033522A discloses a ferrite-bainite dual-phase steel, wherein the production process is simple. However, the content of aluminum in the designed composition is relatively high. The production is rather difficult, and the cost is high. The tensile strength of the steel is 700-900 MPa. A Chinese Patent Application Publication CN102443735A discloses a ferrite-bainite dual-phase steel of the carbon-manganese family, wherein a staged cooling process is utilized. However, the tensile strength is only 450 MPa. A Chinese Patent Application Publication CN101603153A discloses a 665 MPa-grade ferrite-bainite dual-phase steel, wherein a staged cooling process is also utilized. However, the air cooling time is as long as 12-15 seconds, which is difficult to be fulfilled for thin hot-rolled strip steel.

SUMMARY

One object of the disclosure is to provide a 980 MPa-grade hot-rolled ferrite-bainite dual-phase steel and a method for manufacturing the same, wherein the 980 MPa-grade hot-rolled ferrite-bainite dual-phase steel has a yield strength ≥600 MPa, a tensile strength ≥980 MPa, and an elongation ≥15%. This dual-phase steel shows excellent match between strength, plasticity and toughness, useful for parts requiring good formability, high strength and thinness such as carriage wheels, etc.

To achieve the above object, the technical solution of the disclosure is as follows:

According to the disclosure, a relatively high content of Si is added to guarantee formation of a certain amount of ferrite structure in a limited air cooling time after hot rolling, and enlarge the process window for ferrite formation; a relatively high content of Al is added mainly for formation of the required amount of ferrite in the air cooling stage after rolling; and Nb and Ti are added in combination mainly for refining austenite grains to the largest extent in a finish rolling stage, such that ferrite formed after phase change is finer, helpful for enhancing a steel plate's strength and plasticity. By precise control over the ferrite and bainite amounts in the structure according to the disclosure, a high-strength ferrite-bainite dual-phase steel having a yield strength ≥600 MPa and a tensile strength ≥980 MPa is obtained.

A 980 MPa-grade hot-rolled ferrite-bainite dual-phase steel, comprising chemical elements in percentage by weight of: C: 0.15-0.30%, Si: 0.8-2.0%, Mn: 1.0-2.0%, P≤0.02%, S≤0.005%, O≤0.003%, Al: 0.5-1.0%, N≤0.006%, Nb: 0.01-0.06%, Ti: 0.01-0.05%, with a balance of Fe and unavoidable impurities, wherein the above elements meet the following relationships: 0.05%≤Nb+Ti≤0.10%, 2.5≤Al/C≤5.0.

Preferably, in the chemical elements of the hot-rolled ferrite-bainite dual-phase steel, C: 0.20-0.25% in weight percentage.

Preferably, in the chemical elements of the hot-rolled ferrite-bainite dual-phase steel, Si: 1.2-1.8% in weight percentage.

Preferably, in the chemical elements of the hot-rolled ferrite-bainite dual-phase steel, Mn: 1.4-1.8% in weight percentage.

Preferably, in the chemical elements of the hot-rolled ferrite-bainite dual-phase steel, Nb: 0.03-0.05% in weight percentage.

Preferably, in the chemical elements of the hot-rolled ferrite-bainite dual-phase steel, Ti: 0.02-0.04% in weight percentage.

Further, the hot-rolled ferrite-bainite dual-phase steel has a microstructure of ferrite+bainite, wherein the ferrite has a volume fraction of 20-35% and an average grain size of 5-10 μm; and the bainite has a volume fraction of 65-80% and an equivalent grain size ≤20 μm.

The hot-rolled ferrite-bainite dual-phase steel according to the disclosure has a yield strength ≥600 MPa, a tensile strength ≥980 MPa and an elongation ≥15%.

In the compositional design of the steel according to the disclosure:

Carbon: Carbon is an essential element in steel, and it's also one of the most important elements in the technical solution of the disclosure. Caron enlarges an austenite phase zone and stabilizes austenite. As an interstitial atom in steel, carbon plays an important role for increasing steel strength, and has the greatest influence on the yield strength and tensile strength of steel. In the disclosure, for the purpose of obtaining a high-strength dual-phase steel having a tensile strength of grade 980 MPa, a carbon content of 0.15% or higher must be ensured. However, the carbon content shall not exceed 0.30%; otherwise, it will be difficult to form a desired amount of ferrite in a two-stage cooling procedure after hot rolling. Therefore, the carbon content in the steel according to the disclosure should be controlled at 0.15-0.30%, preferably 0.20-0.25%.

Silicon: Silicon is an essential element in steel, and it's also one of the most important elements in the technical solution of the disclosure. The reason for this is that, in order to obtain a ferrite-bainite dual-phase steel having a tensile strength of 980 MPa or higher, the size and amount of ferrite shall be controlled on the one hand, and the bainite strength shall be increased on the other hand. This requires suitable increase of carbon and magnesium contents in the compositional design. However, both carbon and magnesium are elements capable of enlarging an austenite zone and stabilizing austenite. In the very short period of time during air cooling after hot rolling (typically ≤10 s), it's difficult to form an adequate amount of ferrite. This requires addition of a relatively high content of silicon element. The addition of silicon can obviously promote formation of ferrite, enlarge the process window for ferrite formation, and purify ferrite. At the same time, it can also play a role in part for strengthening. Only when the content of silicon reaches 0.8% or higher can silicon shows this effect. Nevertheless, the Si content shall also not be too high; otherwise, the impact toughness of a rolled steel plate will be degraded. Therefore, the silicon content in the steel according to the disclosure is controlled at 0.8-2.0%, preferably 1.2-1.8%.

Manganese: Manganese is also one of the most essential elements in steel, and it's also one of the most important elements in the technical solution of the disclosure. It's well known that manganese is an important element for enlarging an austenite phase zone, and it can reduce the critical quenching rate of steel, stabilize austenite, refine grains, and delay transformation of austenite to pearlite. In the present disclosure, in order to guarantee the strength of a steel plate, the manganese content is generally controlled at 1.0% or higher. If the manganese content is too low, overcooled austenite will not be stable enough, and tend to transform into a pearlite type structure during air cooling. Meanwhile, the manganese content shall not exceed 2.0%. If it exceeds 2.0%, not only Mn segregation tends to occur in steel making, but it will also be difficult to form a sufficient amount of ferrite in an air cooling stage after rolling. Moreover, hot cracking tends to occur during continuous casting of slabs. Therefore, the Mn content in the steel according to the disclosure is controlled at 1.0-2.0%, preferably 1.4-1.8%.

Phosphorus: Phosphorus is an impurity element in steel. Phosphorus has a strong propensity to segregate to a grain boundary. When the phosphorus content in the steel is relatively high (≥0.1%), $Fe_2P$ will form and precipitate around the grains, leading to decreased plasticity and toughness of the steel. Therefore, its content should be as low as possible. Generally, it's desirable to control its content within 0.02%, so that the steel making cost will not be increased.

Sulfur: Sulfur is an impurity element in steel. Sulfur in the steel often combines with manganese to form MnS inclusion. Particularly, when the contents of both sulfur and manganese are relatively high, a large amount of MnS will form in the steel. MnS has certain plasticity itself, and MnS will deform in the rolling direction in a subsequent rolling process, so that the lateral tensile behavior of the steel plate will be degraded. Therefore, the sulfur content in the steel should be as low as possible. In practical production, it's generally controlled within 0.005%.

Aluminum: Aluminum is one of the important alloy elements in the technical solution of the disclosure. In the compositional design of the high-strength ferrite-bainite dual-phase steel involved in the disclosure, the carbon and manganese contents in the steel are higher than those in other low-strength ferrite-bainite dual-phase steel, so austenite is more stable, and it's difficult to form ferrite in the air cooling stage of a staged cooling procedure after rolling. Aluminum is one of the important elements that promote ferrite formation. Therefore, the aluminum content in the disclosure is an order of magnitude higher than that in conventional high-strength steel. The amount of aluminum added into the steel is mainly related to the carbon content. Their amounts that are added shall meet $2.5 \leq Al/C \leq 5.0$. If the aluminum content is undesirably low, an adequate amount of ferrite cannot be formed in the air cooling stage; if the aluminum content is too high, casting of molten steel will become difficult, and longitudinal cracks and like defects tend to occur on a slab surface. Therefore, the aluminum content in the steel according to the disclosure is controlled at 0.5-1.0%, and meets the requirement of the following relationship: $2.5 \leq Al/C \leq 5.0$.

Nitrogen: Nitrogen is an impurity element in the disclosure, and its content should be as low as possible. Nitrogen is also an unavoidable element in steel. In typical cases, the amount of residual nitrogen in steel is generally ≤0.006% if no special controlling measures are taken in steel making. This nitrogen element in a solid dissolved or free form must be immobilized by formation of a nitride. Otherwise, free nitrogen atoms will be very detrimental to the impact toughness of the steel. Furthermore, full-length zigzag crack defects will be easily formed in the course of rolling strip steel. In the disclosure, nitrogen atoms are immobilized by addition of titanium element which combines with nitrogen to form stable TiN. Therefore, the nitrogen content in the steel according to the disclosure is controlled within 0.006% and the lower, the better.

Niobium: Niobium is also one of the key elements in the disclosure. It's generally necessary to add a relatively large content of silicon to hot continuously rolled ferrite-bainite dual-phase steel of 980 MPa or higher grade to promote formation of ferrite phase in rolling and air cooling. However, addition of a high content of silicon will generally increase the brittleness of bainite. Although the carbon content itself is ≤0.30% in the disclosure, after precipitation of a certain amount of ferrite, carbon atoms in the ferrite will be released and enter into austenite that has not transformed, such that carbon concentrates in the remaining austenite, and the content of carbides in bainite formed finally is too high, undesirable for impact toughness. In order to maximize impact toughness of high Si type ferrite-bainite dual-phase steel, a minute amount of niobium is added in the alloy compositional design. The impact toughness of the dual-phase steel can be enhanced effectively by refining grains. The addition of niobium has two effects. First, at a high temperature stage, solid dissolved niobium has a solute drag effect during growth of austenite grains. Second, at a finish rolling stage, niobium carbonitride pins austenite grain boundaries, refines austenite grains, and refines ferrite and bainite transformed finally, so as to enhance the impact toughness of the dual-phase steel. Therefore, the niobium content in the steel according to the disclosure is controlled at 0.01-0.06%, preferably in the range of 0.03-0.05%.

Titanium: Titanium is one of the important elements in the technical solution of the disclosure. Titanium has two major effects in the disclosure. First, titanium combines with impurity element nitrogen in steel to form TiN, so it has an effect of nitrogen immobilization. Second, titanium cooperates with niobium to optimize refining of austenite grains. Free nitrogen atoms in steel are very disadvantageous to impact toughness of steel. Addition of a minute amount of titanium can immobilize the free nitrogen. However, the titanium content in the disclosure should not be too high. Otherwise, TiN of a large size may be formed easily, which is also undesirable for the impact toughness of steel. As verified by experiments, if only Nb is added into steel without addition of Ti, cracked corners tend to form in a continuously cast slab during continuous casting production. Addition of a minute amount of titanium can alleviate the corner cracking problem effectively. Meanwhile, with the proviso that the Nb and Ti contents in the disclosure are controlled in the range of $0.05\% \leq Nb+Ti \leq 0.10\%$, the grain refining effect can be achieved well, and the cost is relatively low. Therefore, the titanium content in the steel according to the disclosure is controlled at 0.01-0.05%, preferably in the range of 0.02-0.04%.

Oxygen: Oxygen is an unavoidable element in steel making. For the present disclosure, the oxygen content in the steel is generally 30 ppm or lower after deoxygenation with Al, and thus there is no obvious negative influence on the properties of the steel plate. Therefore, it's acceptable to control the oxygen content in the steel within 30 ppm.

A method for manufacturing the 980 MPa-grade hot-rolled ferrite-bainite dual-phase steel according to the disclosure, comprising the following steps:

1) Smelting and casting

The above chemical composition is smelted, refined and casted into a cast blank or cast billet;

2) Heating of the cast blank or cast billet

The heating temperature is 1100-1200° C., and the heating time is 1-2 hours;

3) Hot rolling+staged cooling+coiling

A blooming temperature is 1030-1150° C., wherein 3-5 passes of rough rolling are performed at a temperature of 1000° C. or higher, and an accumulated deformation is ≥50%; a hold temperature for an intermediate blank is 900-950° C., followed by 3-5 passes of finish rolling with an accumulated deformation ≥70%; a final rolling temperature is 800-900° C., wherein a steel plate obtained after the final rolling is finished with water cooled to 600-700° C. at a cooling rate ≥100° C./s; after cooled in air for 3-10 seconds, the steel plate is water cooled again to 350-500° C. at a cooling rate ≥30-50° C./s for coiling, and after coiling, the resulting coil is cooled to room temperature at a cooling rate ≤20° C./h.

The manufacture process of the disclosure is designed for the following reasons.

See FIG. 1 for a schematic view of a rolling process according to the disclosure. In the design of the rolling process, at a rough rolling stage and a finish rolling stage, the rolling procedure shall be completed as quickly as possible. After the final rolling is finished, rapid cooling is performed at a high cooling rate (≥100° C./s) to an intermediate temperature at which the cooling is paused. The reason for this is that, if the cooling rate is slow after the rolling is finished, austenite formed inside the steel plate will finish recrystallization in a very short period of time, during which the austenite grains will grow large. When the relatively coarse austenite transforms into ferrite during subsequent cooling, ferrite grains formed along original austenite grain boundaries will be coarse, generally in the range of 10-20 μm, undesirable for improving the strength of the steel plate.

The design concept of the steel plate structures according to the disclosure are fine equiaxed ferrite and bainite structures. To achieve a 980 MPa-grade tensile strength, the average grain size of ferrite must be controlled at 10 μm or lower. This requires that, after the final rolling is finished, the steel plate must be cooled rapidly to the desired intermediate temperature at which the cooling is paused. Since the disclosure involves low-carbon steel, there is a great force driving phase change toward ferrite which can form easily. Therefore, after the final rolling, the cooling rate of the strip steel should be quick enough (≥100° C./s) to avoid formation of ferrite during cooling.

In the staged cooling course according to the disclosure, the cooling-pause temperature in the first stage should be controlled in the range of 600-700° C., for the reason that the strip steel moves quickly in a hot continuous rolling production line, and the length of a water cooling stage is limited, so that it's unlikely to perform air cooling for a long time. The cooling-pause temperature in the first stage should be controlled as far as possible in the optimal temperature range in which ferrite precipitates. The main purpose of the water cooling in the second stage is formation of the desired bainite. The water cooling rate in the second stage should be controlled in the range of 30-50° C./s. An unduly high cooling rate may result in excessive stress inside the steel plate, and the strip steel will have a poor plate shape. The coiling temperature only needs to be controlled in the range of 350-500° C. FIG. 2 shows a specific cooling process schematically.

A high-strength hot-rolled ferrite-bainite dual-phase steel having good strength and plasticity can be obtained by the ingenious, reasonable compositional design in coordination with the novel hot rolling process according to the disclosure. The structures of the steel plate are fine ferrite and bainite, wherein the ferrite has a volume fraction of 20-35% and an average grain size of 5-10 μm, and the bainite has a volume fraction of 65-80% and an equivalent grain size ≤20 μm. In the compositional design, as a result of theoretical analysis and experimental study, the low-yield-ratio, high-strength hot-rolled ferrite-bainite dual-phase steel having both good plasticity and good impact toughness can be obtained only when the total amount of Nb and Ti meets $0.05\% \leq Nb+Ti \leq 0.10\%$, and the addition of carbon and aluminum meets $2.5 \leq Al/C \leq 5.0$, in conjunction with the required rolling process.

The beneficial effects of the disclosure include:

(1) A low-yield-ratio, high-strength hot-rolled ferrite-bainite dual-phase steel can be manufactured according to the disclosure by adopting a relatively economical compositional design concept in conjunction with an existing hot continuous rolling production line.

(2) A hot-rolled high-strength ferrite-bainite dual-phase steel plate having a yield strength ≥600 MPa, a tensile strength ≥980 MPa, an elongation ≥15% and a thickness ≤6 mm is manufactured according to the disclosure. This steel plate exhibits excellently matched strength, plasticity and toughness, as well as excellent formability. Additionally, it has a relatively low yield ratio. It is useful for parts requiring high strength and thinness such as carriage wheels, etc, and has a promising prospect of applications.

DETAILED DESCRIPTION

The disclosure will be further illustrated with reference to the following specific Examples.

Table 1 lists the steel compositions in the Examples according to the disclosure; Table 2 lists the manufacture process parameters for the steel in the Examples according to the disclosure; and Table 3 lists the properties of the steel in the Examples according to the disclosure.

The process flow for the Examples according to the disclosure involves: smelting in a converter or electric furnace→secondary refining in a vacuum furnace→casting blank or billet→heating steel blank (billet)→hot rolling+post-rolling staged cooling→coiling steel, wherein the key process parameters are shown in Table 2.

Figure 1:
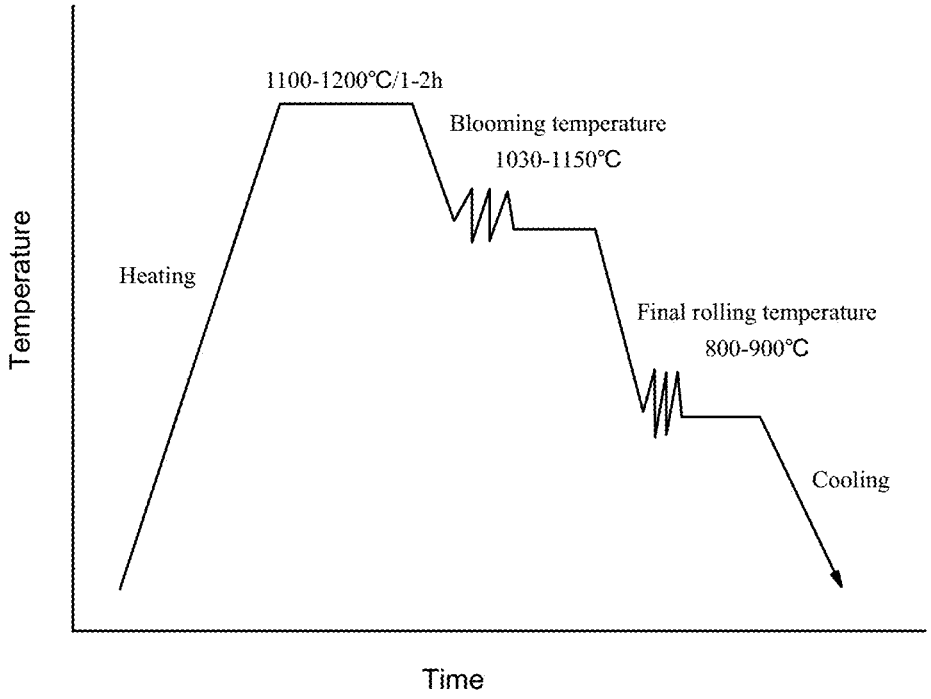
FIG. 1 is a schematic view showing heating and rolling processes according to the disclosure.
Figure 2:
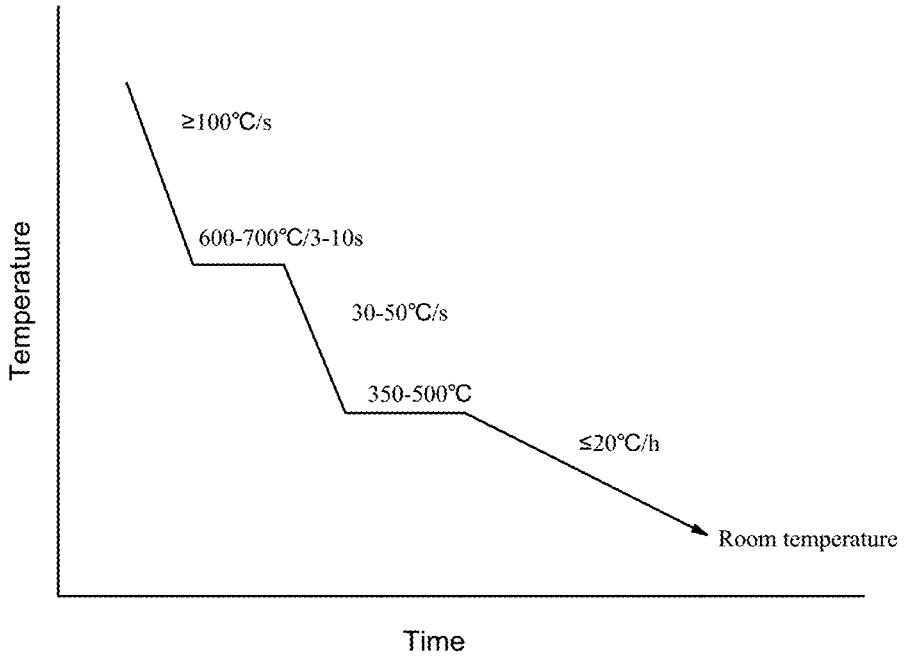
FIG. 2 is a schematic view showing a post-rolling cooling process according to the disclosure.
Figure 3:
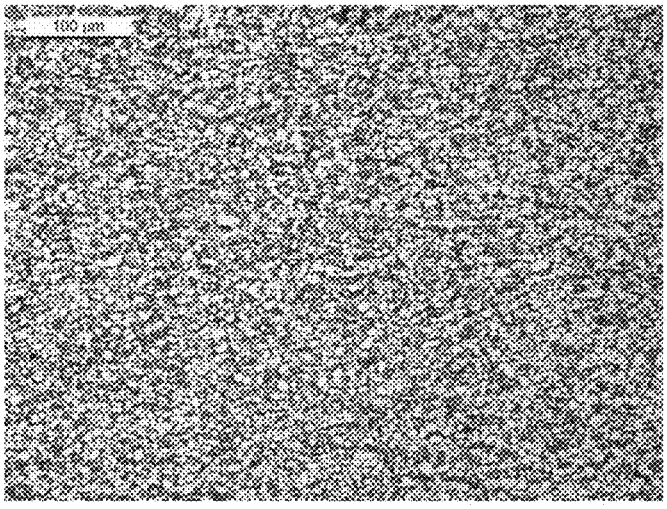
FIG. 3 is a typical metallographical photo of the steel of Example 1 according to the disclosure.
Figure 4:
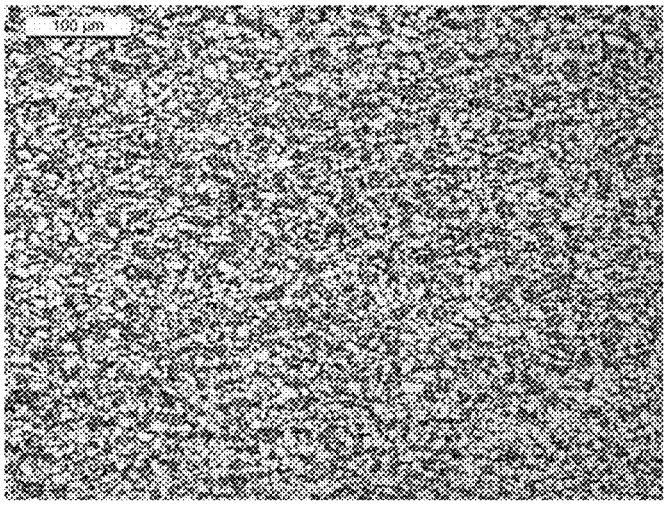
FIG. 4 is a typical metallographical photo of the steel of Example 2 according to the disclosure.
Figure 5:
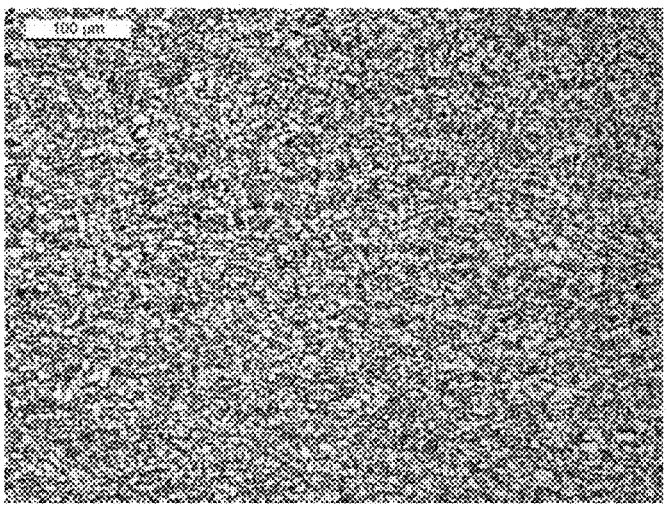
FIG. 5 is a typical metallographical photo of the steel of Example 3 according to the disclosure.
Figure 6:
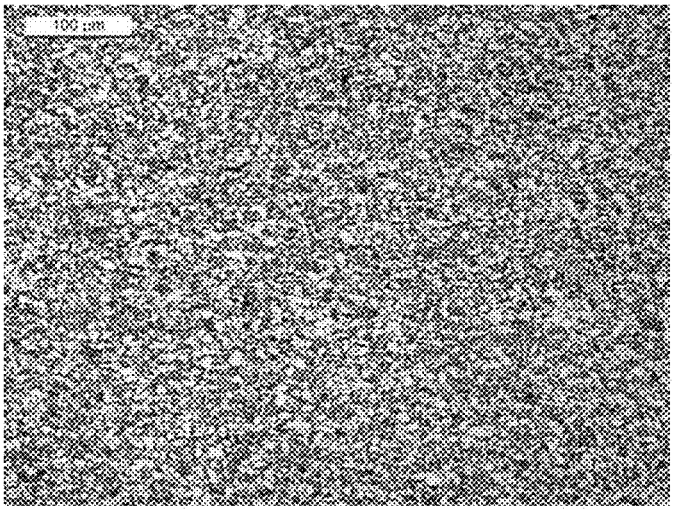
FIG. 6 is a typical metallographical photo of the steel of Example 4 according to the disclosure.
Figure 7:
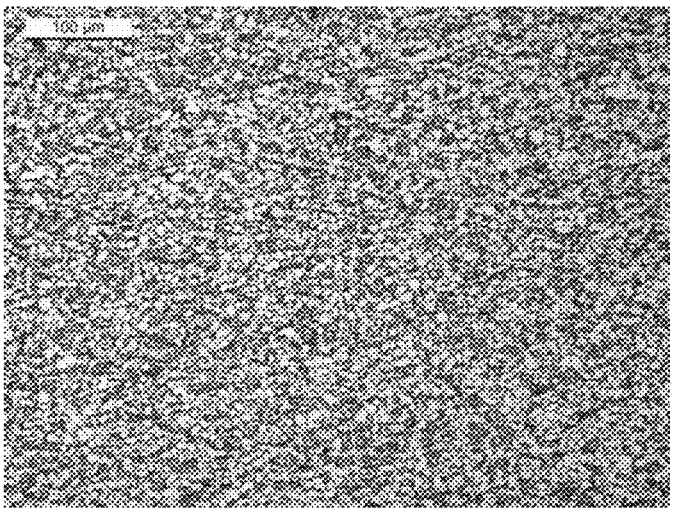
FIG. 7 is a typical metallographical photo of the steel of Example 5 according to the disclosure.

FIGS. 3-7 show the typical metallographical photos of the steel in Examples 1-5 respectively. As can be seen from FIGS. 3-7, the microstructures of the inventive steel plates are fine equiaxed ferrite and bainite (in the figures, the white structure is ferrite, and the grey structure is bainite); ferrite grains are mostly distributed along the original austenite boundaries and have an equivalent grain size is 5-10 μm; and bainite has an equivalent grain size of 20 μm. The microstructures correspond well with the properties of the steel plates. Ferrite in the structures imparts relatively low yield strength to the plates, while the existence of a relatively large amount of bainite (having a volume fraction of 65-80%) confers relatively high tensile strength to the steel plates, such that the ferrite-bainite dual-phase steel according to the disclosure are characterized by good formability, and good match between strength, plasticity and toughness, particularly applicable to fields requiring high strength and thinness, such as carriage wheels, etc.

As shown by Table 3, a 980 MPa-grade ferrite-bainite dual-phase steel can be manufactured according to the disclosure, wherein the dual-phase steel exhibits a yield strength ≥600 MPa, a tensile strength ≥980 MPa, an elongation ≥15%, a relatively low yield ratio, excellent match between strength, plasticity and toughness, particularly applicable to fields requiring high strength and thinness, such as carriage wheels, etc.

TABLE 1 unit: weight %

| | C | Si | Mn | P | S | Al | N | Nb | Ti | O |
|---|---|---|---|---|---|---|---|---|---|---|
| Ex. 1 | 0.21 | 1.28 | 1.90 | 0.006 | 0.0029 | 0.65 | 0.0046 | 0.048 | 0.032 | 0.0026 |
| Ex. 2 | 0.25 | 1.61 | 1.80 | 0.008 | 0.0032 | 0.69 | 0.0042 | 0.036 | 0.048 | 0.0029 |
| Ex. 3 | 0.29 | 1.92 | 1.15 | 0.009 | 0.0028 | 0.98 | 0.0036 | 0.040 | 0.011 | 0.0027 |
| Ex. 4 | 0.27 | 1.75 | 1.23 | 0.008 | 0.0027 | 0.86 | 0.0048 | 0.023 | 0.030 | 0.0025 |
| Ex. 5 | 0.16 | 1.08 | 1.75 | 0.009 | 0.0033 | 0.50 | 0.0044 | 0.048 | 0.050 | 0.0028 |

TABLE 2

| | Rolling Process (Steel blank thickness: 120 mm) | | | | | | | | | | | |
|---|---|---|---|---|---|---|---|---|---|---|---|---|
| | Heating Temperature (° C.) | Blooming Temperature (° C.) | Accumulated Deformation By Rough Rolling (%) | Hold Temperature of Intermediate Blank (° C.) | Accumulated Deformation By Finish Rolling (%) | Final Rolling Temperature (° C.) | Post-rolling Cooling Rate (° C./s) | Cooling-pause Temperature (° C.) | Air Cooling Time (s) | Steel Plate Thickness (mm) | Water Cooling Rate (° C./s) | Coiling; Temperature (° C.) |
| Ex. 1 | 1130 | 1050 | 70 | 950 | 89 | 900 | 100 | 600 | 10 | 4 | 30 | 470 |
| Ex. 2 | 1150 | 1080 | 50 | 900 | 92 | 850 | 120 | 650 | 7 | 5 | 40 | 430 |
| Ex. 3 | 1200 | 1150 | 65 | 930 | 90 | 880 | 110 | 670 | 8 | 4 | 35 | 360 |
| Ex. 4 | 1110 | 1030 | 55 | 910 | 94 | 800 | 150 | 700 | 3 | 3 | 45 | 400 |
| Ex. 5 | 1180 | 1120 | 60 | 940 | 88 | 820 | 130 | 680 | 5 | 6 | 50 | 500 |

TABLE 3

| | Yield Strength (MPa) | Tensile Strength (MPa) | Yield Ratio | Elongation (A, %) |
|---|---|---|---|---|
| Ex. 1 | 734 | 1020 | 0.72 | 18.0 |
| Ex. 2 | 732 | 1046 | 0.70 | 17.0 |
| Ex. 3 | 784 | 1074 | 0.73 | 16.5 |
| Ex. 4 | 751 | 1058 | 0.71 | 17.0 |
| Ex. 5 | 706 | 1008 | 0.70 | 18.0 |

What is claimed is:

1. A hot-rolled ferrite-bainite dual-phase steel with a tensile strength ≥980 MPa, comprising chemical elements in percentage by weight of: C: 0.15-0.30%, Si: 0.8-2.0%, Mn: 1.0-2.0%, P≤0.02%, S≤0.005%, O≤0.003%, Al: 0.5-1.0%, N≤0.006%, Nb: 0.01-0.06%, Ti: 0.01-0.05%, with a balance of Fe and unavoidable impurities, wherein the above elements meet the following relationships: 0.05%≤Nb+Ti≤0.10%, 2.5≤Al/C≤5.0, wherein the hot-rolled ferrite-bainite dual-phase steel has a microstructure consisting of ferrite+bainite, wherein the ferrite has a volume fraction of 20-35% and an average grain size of 5-10 μm; and the bainite has a volume fraction of 65-80% and an equivalent grain size ≤20 μm.

2. The hot-rolled ferrite-bainite dual-phase steel according to claim 1, wherein the hot-rolled ferrite-bainite dual-phase steel comprises C: 0.20-0.25% in weight percentage.

3. The hot-rolled ferrite-bainite dual-phase steel according to claim 1, wherein the hot-rolled ferrite-bainite dual-phase steel comprises Si: 1.2-1.8% in weight percentage.

4. The hot-rolled ferrite-bainite dual-phase steel according to claim 1, wherein the hot-rolled ferrite-bainite dual-phase steel comprises Mn: 1.4-1.8% in weight percentage.

5. The hot-rolled ferrite-bainite dual-phase steel according to claim 1, wherein the hot-rolled ferrite-bainite dual-phase steel comprises Nb: 0.03-0.05% in weight percentage.

6. The hot-rolled ferrite-bainite dual-phase steel according to claim 1, wherein the hot-rolled ferrite-bainite dual-phase steel comprises Ti: 0.02-0.04% in weight percentage.

7. The hot-rolled ferrite-bainite dual-phase steel according to claim 1, wherein the hot-rolled ferrite-bainite dual-phase steel has a yield strength ≥600 MPa, and an elongation ≥15%.

8. A method for manufacturing the hot-rolled ferrite-bainite dual-phase steel of claim 1, comprising the following steps:

a) Smelting and casting, wherein a chemical composition of claim 1 is smelted, refined and casted into a cast blank or cast billet;

b) Heating of the cast blank or cast billet at heating temperature: 1100-1200° C., heating time: 1-2 hours;

c) Hot rolling+staged cooling+coiling, wherein a blooming temperature is 1030-1150° C., wherein 3-5 passes of rough rolling are performed at a temperature of 1000° C. or higher, and an accumulated deformation is ≥50%; a hold temperature for an intermediate blank is 900-950° C., followed by 3-5 passes of finish rolling with an accumulated deformation ≥70%; a final rolling temperature is 800-900° C., wherein a steel plate obtained after the final rolling is finished with water cooled to 600-700° C. at a cooling rate ≥100° C./s; after cooled in air for 3-10 seconds, the steel plate is water cooled again to 350-500° C. at a cooling rate ≥30-50° C./s for coiling, and after coiling, a resulting coil is cooled to room temperature at a cooling rate ≤20° C./h.

9. The method for manufacturing the hot-rolled ferrite-bainite dual-phase steel according to claim 8, wherein the hot-rolled ferrite-bainite dual-phase steel has a yield strength ≥600 MPa, and an elongation ≥15%.

10. The hot-rolled ferrite-bainite dual-phase steel according to claim 2, wherein the hot-rolled ferrite-bainite dual-phase steel has a yield strength ≥600 MPa, and an elongation ≥15%.

11. The hot-rolled ferrite-bainite dual-phase steel according to claim 3, wherein the hot-rolled ferrite-bainite dual-phase steel has a yield strength ≥600 MPa, and an elongation ≥15%.

12. The hot-rolled ferrite-bainite dual-phase steel according to claim 4, wherein the hot-rolled ferrite-bainite dual-phase steel has a yield strength ≥600 MPa, and an elongation ≥15%.

* * * * *